US005471972A

United States Patent [19]

Corliss, II et al.

[11] Patent Number: 5,471,972

[45] Date of Patent: Dec. 5, 1995

[54] SELF-CLEANING GAS-FUELED OVEN FOR COOKING

[75] Inventors: John M. Corliss, II, Arlington; Philip C. Carbone, Groveland, both of Mass.

[73] Assignee: Gas Research Institute, Chicago, Ill.

[21] Appl. No.: 150,223

[22] Filed: Nov. 10, 1993

[51] Int. Cl.[6] ..... F24C 15/32

[52] U.S. Cl. ..... 126/21 A; 126/92 R; 431/328; 431/326

[58] Field of Search ..... 126/21 R, 91 R, 126/92 AC, 92 R, 152 R, 21 A; 431/326–329, 350, 353; 239/556–561, 554, 555

[56] References Cited

U.S. PATENT DOCUMENTS

| | | | |
|---|---|---|---|
| 1,045,469 | 11/1912 | Van Zandt | 239/559 |
| 3,251,396 | 5/1966 | Nitsche | 431/328 |
| 3,270,967 | 9/1966 | Westerman et al. | 239/560 |
| 3,359,965 | 12/1967 | Milligan | 126/92 B |
| 4,403,597 | 9/1983 | Miller | 431/326 |
| 4,639,213 | 1/1987 | Simpson | 126/92 AC |

FOREIGN PATENT DOCUMENTS

| | | | |
|---|---|---|---|
| 1310217 | 12/1989 | Japan | 431/326 |

*Primary Examiner*—James C. Yeung
*Attorney, Agent, or Firm*—Dick and Harris

[57] ABSTRACT

A self-cleaning gas-fueled oven for cooking with a flameholder and door which permit self-cleaning at temperatures exceeding 900° F. The flameholder has a grille divided into two opposed, substantially flat portions, each of which contains an array of ports of two distinct sizes. The smaller-sized ports are tapered, increasing in cross-sectional area in the direction of gas flow through the grille. The oven door has a lip extending substantially perpendicularly from the door's sidewalls so as to overlap the periphery of the door's inner panel.

24 Claims, 9 Drawing Sheets

SELF-CLEANING GAS-FUELED OVEN FOR COOKING

FIELD OF THE INVENTION

This invention relates generally to Self-cleaning, gas-fueled ovens, and more particularly to a self-cleaning, gas-fueled oven for cooking which is capable of self-cleaning at temperatures exceeding 900° F.

BACKGROUND AND OBJECTS OF THE INVENTION

Self-cleaning ovens, by design, must be capable of operation at higher temperatures than those associated with normal cooking. The self-cleaning process, known as pyrolytic cleaning, requires temperatures sufficiently high to incinerate food soils deposited or "baked on" the ovens' walls. Generally speaking, the shorter an oven's self-cleaning cycle—the period of time required to heat the oven to self-cleaning temperature, operate the oven at the self-cleaning temperature, and then return the oven to a normal, cooking temperature—the higher the oven temperature required for incineration.

Prior to the present invention, no gas-fueled oven for cooking has been developed which is capable of repeatedly self-cleaning at temperatures exceeding approximately 900 ° F. because of structural limitations of the oven. For the case of residential ovens, there has been little need to develop a self cleaning, gas fueled oven capable of cleaning at temperatures above 900° F., since the approximately four hours long self-cleaning cycle typical of residential ovens which self-clean at temperatures near 900° F. without a convection fan is short enough not to significantly affect the availability of the oven for household cooking purposes. For the case of commercial ovens, however, there has been a substantial need to develop an oven capable of cleaning at temperatures above 900° F., since a self-cleaning cycle of four hours, or even two hours, is sufficiently long to cut into a restaurant's food production efficiency.

In view of the above, one object of the invention is to provide a self-cleaning, gas-fueled cooking oven which is capable of repeatedly self-cleaning at temperatures exceeding 900° F.

Cost and durability have been the principal factors which have thwarted the development of a faster-cleaning gas-fueled oven. An oven with only the typical one-stage gas burner takes too long to reach temperatures exceeding 900° F. Adding a second such burner, to be turned on in conjunction with the first when self-cleaning is desired, solves this problem, but creates a second problem. The second burner requires second, separate safety and ignition systems, increasing the cost of the oven to a point where it may exceed the savings gained by reducing the time the oven is taken out of productive use for self-cleaning.

If a single two-stage gas burner is used in place of the typical one-stage burner, with the first, lower output stage used for cooking and the second, higher output stage used for self-cleaning, the cost problem associated with a two burner system is avoided, but the problem of designing and fabricating a flameholder which will accommodate both output stages is presented.

The function of a flameholder is, for a given flow rate of a fuel mixture through a burner, to maintain combustion by holding the flame produced by the burner a relatively fixed distance away from the burner. Flameholders commonly use ports for maintaining safe combustion. A standard starting point for flameholder design is finding the quench diameter, the port diameter for which the flame is self-extinguishing. A self-extinguishing flame is one which does not propagate a sufficient distance back toward the burner to cause "flashback". Flashback, which can cause excessive heating on the burner and can thus ruin it, occurs when gas behind the flameholder is ignited. To prevent such ignition, the flame must not be allowed to settle so close to the flameholder that the flameholder is heated to combustion temperature. The quench diameter depends upon several factors, including the fuel being used, the ratio of air to fuel in the fuel mixture, and the velocity of the fuel mixture as it leaves the port; it can be calculated using formulas known to those skilled in the art.

Once the quench diameter is determined, the port area needed to accommodate the expected burner output is customarily calculated, again using formulas known to those skilled in the art. The port area is the cross-sectional area of the port perpendicular to the direction of flow through the port. The greater the expected burner output, the larger the port area generally required to prevent the flame from lifting off the burner. If the port area required exceeds the quench diameter, more than one port may be required.

If the burner for the flameholder being designed has two output stages (for example, the cooking stage is defined by a range of temperatures, while the cleaning stage is defined by a single temperature at a higher rate of consumption of gas) rather than the usual single output stage, the required port size can be determined by calculating the quench diameter for the lower output stage. The number of required ports of this size can then be determined by calculating the total port area needed to prevent lift-off. When the design is for a commercial gas oven with a desired maximum cooking temperature below 500° F. and a desired self-cleaning temperature exceeding 900° F., heretofore unsolved problems are presented. First, the number of ports required is very large, resulting in unattractive fabrication costs. Second, the multitude of similarly sized flames produced by these ports causes a type of oscillation known as "combustion driven oscillation," which generates intolerable noise. Third, the tops and bottoms of typical relatively long but shallow oven burner boxes cannot tolerate the heat directed upward and downward by common cylindrical flameholders.

Accordingly, another object of the invention is to provide a flameholder which can accommodate a single gas burner of two or more stages using fewer ports than typical prior multistage flameholders.

A further object of the invention is to provide a flameholder which can accommodate a single gas burner of two or more stages without producing intolerable noise.

Another object of the invention is to provide a flameholder which does not cause the top and bottom of a common gas oven burner box to overheat at temperatures exceeding 900° F.

Another problem which must be addressed in designing a gas-fueled oven which self-cleans at temperatures exceeding 900° F. is associated with the temperature differential which develops between the inner and outer portions of the oven door. Both portions are commonly composed of a panel with interconnected sidewalls. They are fit together like the top and bottom of a shoe box, with the outer portion, often called the "skin," overlapping the inner portion. Screws along the sidewalls are commonly used to hold the two portions together. When the temperature of the door is raised, the inner portion of the door expands relative to the overlapping outer portion, stressing the sidewalls. Repeated heating of the oven to temperatures exceeding 900° F. causes the sidewalls to distort peripherally so that the door substantially loses its heat-sealing capability.

Accordingly, still another object of the invention is to provide a door for an oven which can withstand repeated heating of the oven to temperatures exceeding 900° F.

Finally, a more general object of the present invention is to provide a self-cleaning oven having combined features which overcome or reduce the above-noted problems of the prior art.

SUMMARY OF THE INVENTION

The above and other objects of the invention are achieved, at least in part, by providing an oven with at least a two-stage burner, one stage for producing oven temperatures below 500° F. and another stage for producing oven temperatures above 900° F.; a flameholder for the burner which has a grille divided into two opposed, substantially flat portions, each portion containing multiple ports of two distinct sizes, with the ports of the smaller size increasing in cross-sectional area from the inner surface of the grille to the outer surface (wherein gas flows through the ports in a direction from the inner surface to the outer surface); and an oven door which has a lip extending substantially perpendicularly from the door's sidewalls so as to overlap the periphery of the door's inner panel.

More specifically, in accordance with one aspect of the invention, a flameholder for a gas burner operable at at least two stages is provided. The flameholder includes a grille having multiple ports between opposed inner and outer surfaces. The ports are divided into two sets. The first set contains ports having an increasing cross-sectional area from the inner surface of the grille to the outer surface. The increasing cross-sectional area substantially reduces the number of ports required to prevent lift-off of the flames during self-cleaning operation. The second set contains ports which do not necessarily have an increasing cross-sectional area from the inner surface of the grille to the outer surface, but which have a greater minimum cross-sectional area than the minimum cross-sectional area of each port of the first set. The inclusion of these ports reduces the noise produced by the flameholder during self-cleaning operation. The grille is divided into two opposed, substantially flat portions. This divided shape directs the flames produced by the burner substantially laterally, preventing the top and bottom of the burner box from overheating.

In accordance with another aspect of the invention, a door for an oven is provided which includes a skin with a rectangular outer panel and interconnected sidewalls, and a rectangular inner panel which faces the outer panel. The door further includes a lip which extends substantially perpendicularly from the sidewalls so as to overlap the periphery of the inner panel. The overlapping lip permits peripheral expansion of the inner panel with respect to the sidewalls.

Thus, by reducing the number of ports required to prevent lift-off of the flames produced during operation at the higher of two output levels, by reducing the noise produced at the higher level, and by substantially laterally directing the flames produced by the burner, the flameholder can accommodate a single two-stage gas-fueled oven burner which generates oven temperatures above 900° F. as well as below 500° F. By permitting peripheral expansion of its inner panel with respect to its sidewalls, the oven door can withstand repeated heating of the oven to temperatures exceeding 900° F. Still other objects and advantages of the present invention will become readily apparent to those skilled in this art from the following detailed description wherein only the preferred embodiment is shown and described, simply by way of illustration of the best mode of the invention. As will be realized, the invention is capable of other and different embodiments, and its several details are capable of modifications in various respects, all without departing from the invention. Accordingly, the drawing and description are to be regarded as illustrative in nature, and not restrictive.

BRIEF DESCRIPTION OF THE DRAWINGS

For a fuller understanding of the nature and objects of the present invention, reference should be had to the following drawings, wherein.

DESCRIPTION OF THE PREFERRED EMBODIMENT

Figure 1:
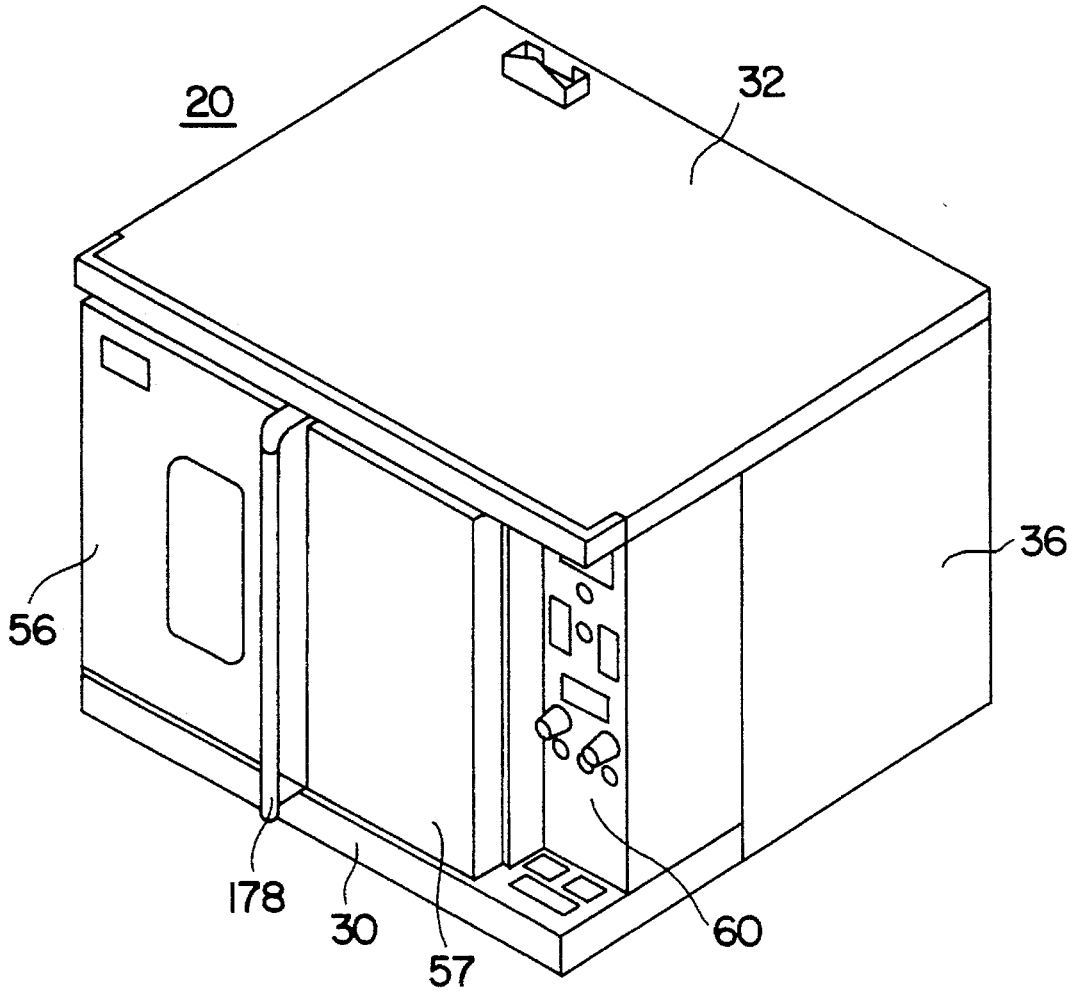
FIG. 1 is an elevational, perspective view of the self-cleaning oven of the present invention.

The invention is based in part upon several discoveries or realizations. One is that the use of tapered ports in a flameholder designed for use in conjunction with a two-stage burner dramatically reduces the number of ports required to accommodate the flames produced by the burner at its higher output level. As the fuel mixture transits the ports from the inner surface of the flameholder to the outer surface, it encounters increasing cross-sectional port area and slows correspondingly. Accordingly, the number of ports needed to prevent lift-off of the flame can be determined from the cross-sectional port area at the outer surface, instead of from the cross-sectional port area at the inner surface. If, for example, the cross-sectional port area is increased by 70 percent from the inner surface to the outer surface using tapered ports, approximately 70 percent less ports need be made in order to accommodate operation at the burner's higher output level than would be the case with ports having uniform cross-sectional areas from the inner surface to the outer surface.

Another realization upon which this invention is in part based is that strategic placement of larger ports among the multiplicity of smaller ports of uniform size in a flameholder designed for used in a two-stage burner dramatically reduces the noise caused by combustion driven oscillation at the burner's higher output level. The flames produced by the larger ports draw out the flames produced by the nearby smaller ports to longer lengths. As a result, the topography of the imaginary surface formed by interconnecting the flames at their tips deviates from the flat topography which tends to induce combustion driven oscillation.

A further realization upon which this invention is in part based is that a flameholder having a properly oriented grille which includes two opposed, substantially flat portions will direct flames substantially laterally, substantially reducing the heat produced above and below the flameholder. As a result, surfaces above and below the flameholder will not tend to overheat at burner output levels producing oven temperatures exceeding 900° F.

Another realization upon which this invention is in part based is that the capacity of the oven door to accommodate repeated heating of the oven to temperatures exceeding 900° F. is increased if the inner and outer portions of the door are made to overlap each other not in a direction perpendicular to the door faces or "panels," as is done for the case of a "shoe box" design door, but, rather, in a direction substantially parallel to the inner panel. With this alignment, the principal direction of expansion of the inner panel is not parallel to the direction of the force which must be applied to hold the door together; instead, it is substantially perpendicular to this direction. Accordingly, provided the inner and outer portions of the door are not held in fixed positions with respect to each other, expansion of the inner panel will not significantly stress the outer portion.

The preferred oven (20), which is illustrated in FIG. 1, is self-cleaning and fueled by natural gas. It is perferably made from the Garland MCO oven manufactured by Garland Commercial Industries of Freeland, Pa., using, in particular, that oven's shell and its combustion air distribution system. It has six sides, with opposite rectangular top (32) and bottom, opposite rectangular front (30) and back, and opposite rectangular sides (36). The preferred oven door, located on the from (30) of the oven (20), is vertically divided into two mated sections (56,57) which can be simultaneously opened and closed using a handle (178) mounted on the larger door section (56). The control panel (60) for the oven (20) is located on the front (30) of the oven (20), adjacent to the preferred oven door.

Figure 2:
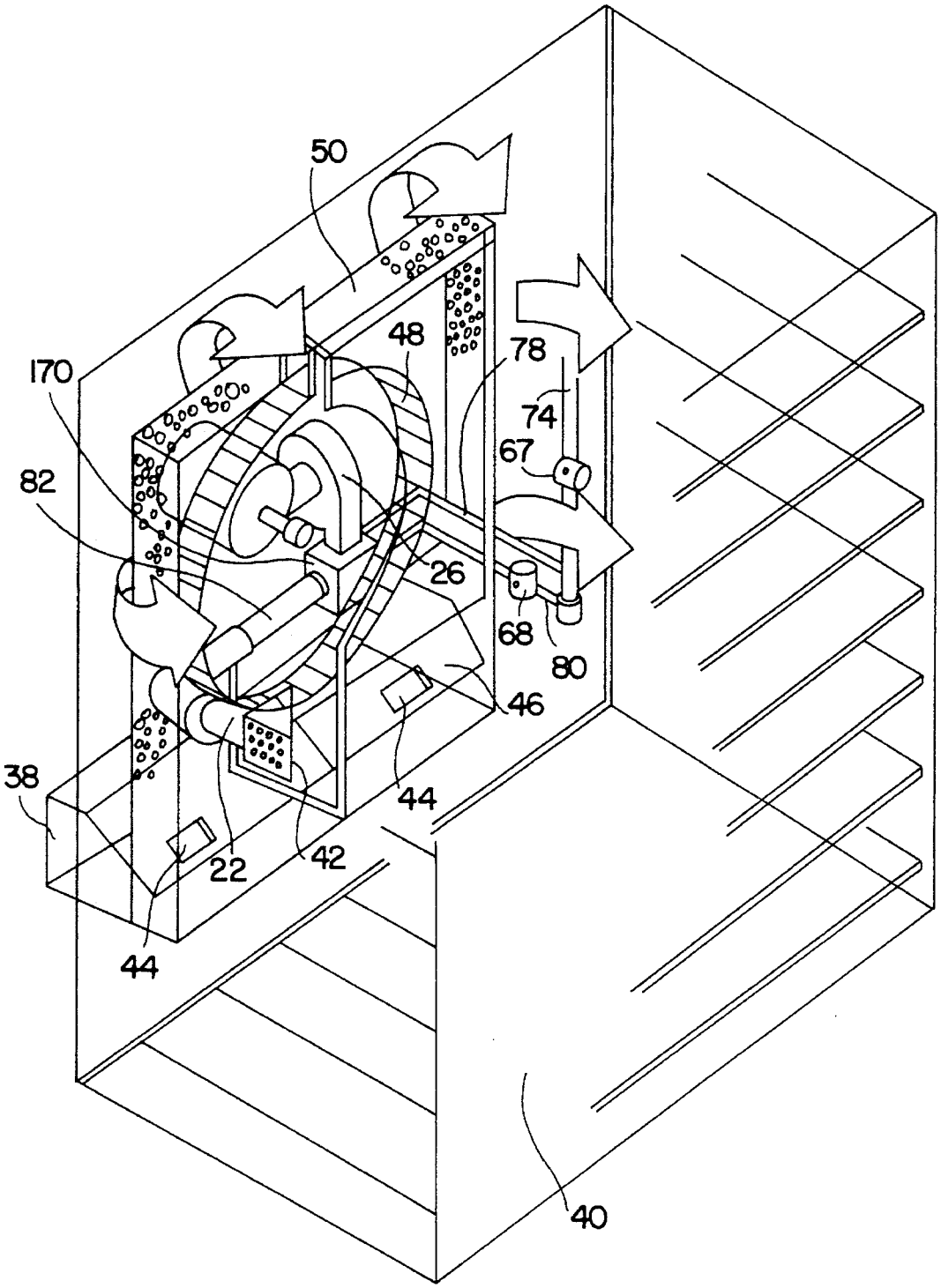
FIG. 2 is an environmental view of the combustion air distribution system for the self-cleaning oven of the present invention.

The oven is "direct-fired," meaning that combustion gas from the oven burner is distributed into the oven cavity (40) itself, as illustrated in FIG. 2. The burner box (38), connecting baffle (50) and convection fan (48) for distributing the combustion gas are positioned at the back of the oven so that a predetermined portion, e.g., approximately twenty-inches-square, of the baffle (50) above the burner box (38) is centered and parallel with respect to the area of the back of the oven cavity (40), e.g., approximately thirty-inches-square. The burner (22) is centrally positioned at the back of the burner box (38) and faces forward. The wedge-shaped preferred flameholder (42), which is mounted in from of the burner (22), directs combustion gas toward both ends of the burner box (38). The front wall (46) of the burner box (38) is beveled to face upwards and forwards toward the baffle (50). It has a rectangular hole (44) near each of its lateral ends. The rectangular holes (44) allow transmission of the combustion gas into the portion of the baffle (50) forward of the convection fan (48).

Figure 3:
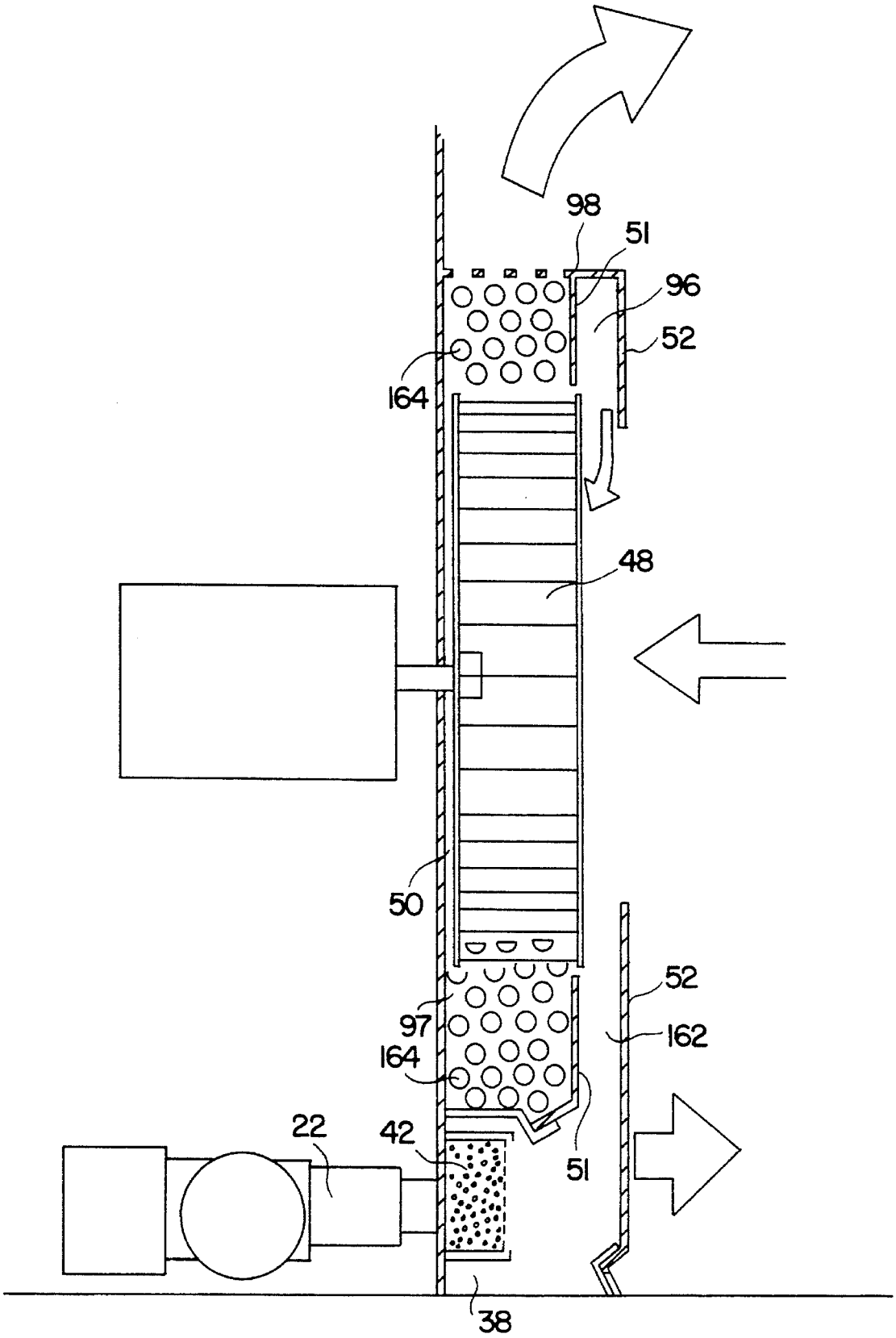
FIG. 3 is a side view of the combustion air distribution system for the self-cleaning oven of the present invention.

As illustrated in FIG. 3, the forward portion (96) of baffle (50) is separated from the remaining rearward portion (97) by a retaining wall (51) which extends inward, from the top and lateral sidewalls (98) of the baffle (50) and from the from wall (46) of the burner box (38) below the baffle (50), to a circular opening which just accommodates the forward edge of the convection fan wheel (160). The preferred baffle (50) is approximately 2.5 inches thick from front to rear, while the front wall (52) of the baffle (50) preferably lies 0.5 inches forward of the retaining wall (51), providing a channel (162) between the walls (51,52) for combustion air to flow from the holes (44) in the front wall (46) of the burner box (38) to the from of the fan (48). The from wall (52) also has a circular opening. This opening is likewise concentric with respect to the periphery of the fan, but it is smaller in diameter, leaving an annular region of the front wall (52) in front of the fan (48) to channel combustion air from the burner box (38) in front of the fan (48). The fan (48) axially draws both recirculation air from the oven cavity and combustion air from the baffle channel (162) through the opening in the front wall (52), then blows the air radially outward into the oven cavity through circular holes (164) in the baffle sidewalls (98).

Figure 4:
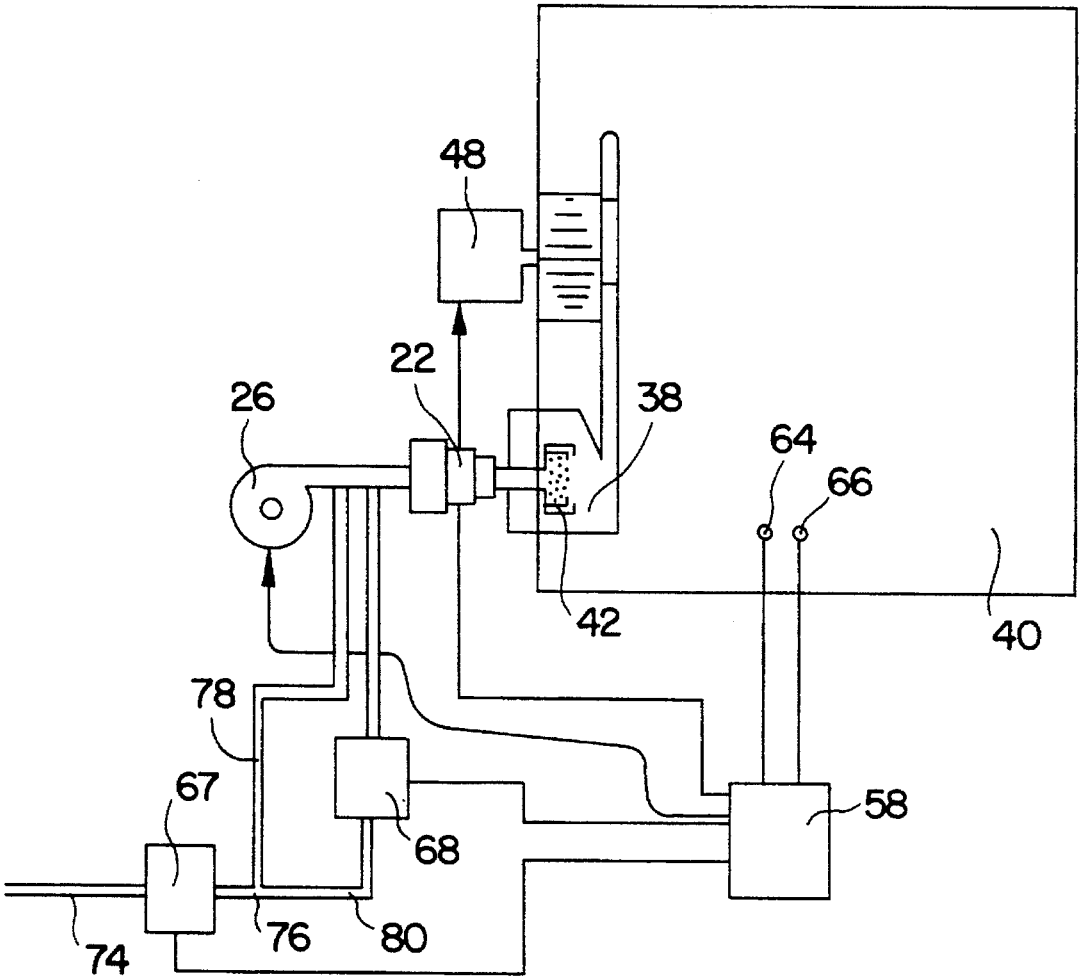
FIG. 4 is a schematic drawing of the self-cleaning oven of the present invention.

The control system for the oven is schematically illustrated in FIG. 4. A solid state controller (58) receives signals from two thermostats (64,66) located inside the oven cavity (40). One of the thermostats (64) is designated for use during cooking, and the other thermostat (66) is designated for use during self-cleaning. Typically the latter thermostat (66) has a set point of 1025° F. for a self-cleaning cycle lasting approximately one hour, or, alternatively, a set point of 1100° F. for a self-cleaning cycle lasting approximately 50 minutes; although the temperature setting and, thus, cleaning time can vary.

In addition to receiving signals to and from the thermostats (64,66), the controller (58) transmits signals to the convection fan (48), the combustion blower (26), and independent primary and secondary gas valves (67,68). The convection fan (48) and combustion blower (26) both have two speeds. The convection fan, for example, has a low speed of 1140 rpm and a high speed of 1760 rpm. The combustion blower (26) is preferably of squirrel cage design. Typically it has a low speed of 1600 rpm and a high speed of 3300 rpm, producing nominal flows of 32 cfm at low speed and 70 cfm at high speed, which are damped to be 9 cfm and 16 cfm, respectively. The primary gas valve (67), which is preferably of redundant design, is situated in the main gas line (74) above a junction (76) where the main gas line (74) divides into first and second gas inlets (78,80) which provide gas to the burner (22).

When the oven is in cooking mode, the convection fan (48) operates at high or low speed and combustion blower (26) operates at low speed, while the primary gas valve (67) is open and the secondary gas valve (68) is closed, producing a burner output of about 45,000 BTU/hr. These systems are activated by the controller (58) during the selected cooking period whenever the thermostat (64) designated for use during cooking signals an oven temperature more than a predetermined amount below its set point, e.g., 3° F. They are deactivated whenever the set point is reached.

When the oven (20) is in self-cleaning mode, the convection fan (48) and combustion blower (26) operate at high speed, while both gas valves (67,68) are open, producing a typical burner output of about 80,000 BTU/hr. These systems are activated by the controller (58) for approximately the first two-thirds of the self-cleaning cycle whenever the thermostat (66) designated for use during self-cleaning signals an oven temperature more than a predetermined amount below its set point, e.g., 25° F. For approximately the final third of the self-cleaning cycle, the systems are deactivated by the controller (58) to allow the oven to cool.

In order to minimize the quantity of pollutants produced by the oven, the air and fuel for the burner are premixed before entering the burner. Referring back to FIG. 2, the combustion blower (26) and gas inlets (78,80) deliver, respectively, air and fuel to a preferably rectangular premixing chamber (170) in a predetermined ratio, preferably twelve parts air to one part gas. Premixing continues in a premixing tube (82) which connects the rectangular premixing chamber (170) to the burner (22). The premixing tube (82) is preferably cylindrical, twelve inches long, 2.0 inches in diameter, and made from 0.065 inch thick cold drawn steel.

Figure 5:
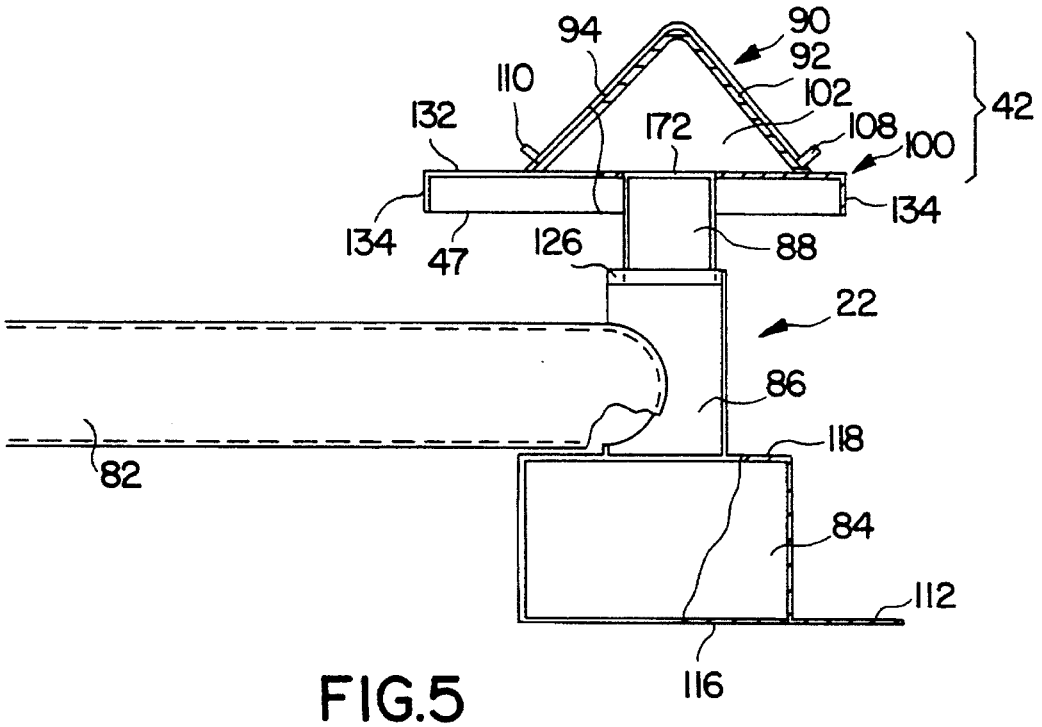
FIG. 5 is a plan view of the burner assembly, partially in cross-section, for the self-cleaning oven of the present invention.
Figure 6:
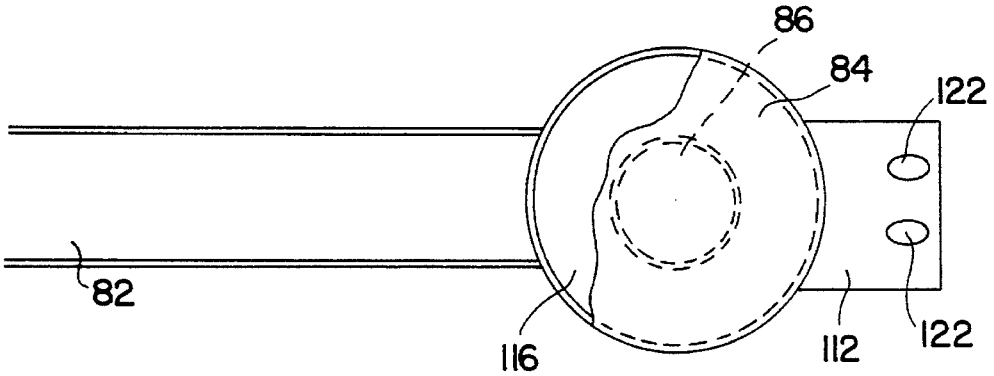
FIG. 6 is a rear view of the burner assembly for the self-cleaning oven of the present invention.
Figure 7:
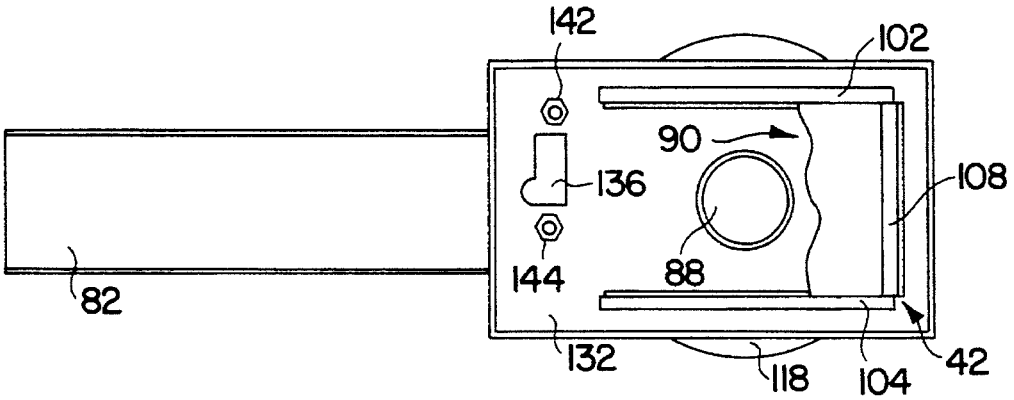
FIG. 7 is a front view of the burner assembly for the self-cleaning oven of the present invention.

The burner assembly, which includes the premixing tube (82), a stabilizing chamber (84), and the preferred flameholder (42) as well as the burner (22), is shown in more detail in FIGS. 5, 6, and 7. Referring first to FIG. 5, a plan view of the burner assembly, partially in cross-section, the fuel mixture enters the burner (22) through the side of the rearward of the burner's two axially connected tubular chambers (86,88). Both chambers (86,88) preferably are made from 0.065 inch cold drawn steel. For a typical oven, the rearward chamber (86) has a diameter of 2.0 inches and length of 3.0 inches; the forward chamber (88) has a diameter of 1.5 inches and length of 1.75 inches; and the two chambers (86,88) are joined by a 0.25 inch thick cold rolled steel annular sleeve (126) having an inner diameter of 1.50 inches and an outer diameter of 1.86 inches. During fabrication of the burner (22), the sleeve (126) preferably is first pressed onto the outer surface of the forward chamber (88), then the rearward chamber (86) is fit over the sleeve (126). The reduction in burner diameter from the rearward chamber (86) to the forward chamber (88) causes the velocity of the fuel mixture to increase as it passes between the chambers (86,88).

To regulate the flow of fuel mixture through the burner (22), and coincidentally substantially reduce burner noise, a stabilizing chamber (84) is axially connected to the rearward end of the burner (22). For a typical oven, the stabilizing chamber (84) is cylindrical, 4.5 inches long by 2.5 inches in diameter, and made from 0.0635 inch thick cold rolled steel. It has a circular rearward face (116) closing its rearward end and an opposite annular forward face (118) which is welded to the rearward end of the burner's rearward chamber (86).

A fastening plate (112), typically made from 0.0635 inch cold rolled steel, is used to secure the burner (22) to the back of the oven. The fastening plate (112) is welded to the rearward face (116) of the stabilizing chamber (84) so that it extends a predetermined distance, e.g., 2.0 inches, laterally from said face (116). Referring now to FIG. 6, a rear view of the burner assembly, screws which fit through two horizontal slots (122) in the fastening plate (112) are used to attach the fastening plate (112) to the back of the oven.

Referring back to FIG. 5, the fuel mixture exits the burner (22) through the open forward end of the forward chamber (88). A hole in the back wall of the burner box, e.g., 2.0 inches in diameter, permits the forward chamber (88) to enter the burner box. The forward end of the burner (22) is secured to the burner box by a mounting plate (100) made, for example, from 0.0635 inch cold rolled steel. The mounting plate (100) is a rectangular panel (132), e.g., 3.88 inches high by 7.13 inches wide, with interconnected sidewalls (134) which extend perpendicularly rearward to meet the back wall (47) of the burner box. A hole (172), e.g., 2.0 inches in diameter, in the panel (132) permits the fuel mixture to flow from the burner (22) into the burner box. The forward end of the burner (22) is welded to the mounting plate (100) at the rim of this hole (172). The mounting plate (100) is welded to the burner box where the interconnected sidewalls (134) of the mounting plate meet the burner box's back wall (47).

Once inside the burner box, the fuel mixture is fed through the flameholder grille (90) and ignited. The grille (90) is made from a rectangular plate which has been bent at a predetermined radius, e.g., 0.25 inches, to form two perpendicular rectangular portions (92,94). It is centered in front of the burner (22) so that the bend dividing the grille (90) lies in the vertical plane of symmetry of the burner (22).

Referring now to FIG. 7, a front view of the burner assembly, the rectangular panel (132) of the mounting plate has a keyhole-shaped hole (136) and two #6-32 carbon steel hexagon nuts (142,144) for mounting the ignitor between the lateral edge of the grille (90) and the lateral edge of the panel (132). The hole (136), typically 1.00 inch high, and nuts (142,144) are vertically aligned along a line from the lateral edge of the panel (132), e.g., at about 1.00 inch. Typically the nuts (142,144) are centered 1.65 vertical inches apart, with the lower nut (144) centered 1.54 inches above the bottom edge of the rectangular panel (132). The keyhole-shaped hole (136) is typically centered midway between the nuts (142,144).

The fuel mixture is prevented from going around the flameholder (42) by the vertical mounting plate (100) rearward of the grille (90) and horizontal top and bottom plates (102,104) having the shape of isosceles right triangles above and below the grille (90). The forward face of the mounting plate panel (132) is affixed to the grille's rearward lateral edges. The triangular top plate (102) is affixed to the forward face of the mounting plate panel (132) and top edge of the grille (90) so that the right angle of the top plate (102) is above the 90° bend of the grille (90). The triangular bottom plate (104) is affixed to the forward face of the mounting plate panel (132) and bottom edge of the grille (90) so that the right angle of the bottom plate (104) is below the 90° bend of the grille (90).

Ignition of the fuel mixture is accomplished by a spark ignitor having a potential, for example, of approximately 8000 volts, with a typical gap between its two electrodes of 0.10 inches. The high potential electrode is spaced, for example approximately 0.25 inch, from the outer surface of the grille (90) (the surface facing away from the burner). Failure to place the ignitor a sufficient distance from the grille (90) will result in a short.

Referring back to FIG. 5, the 45 degree angle of each grille portion (92,94) with respect to the vertical plane of symmetry of the burner (22) causes the flameholder (42) to direct the combustion gas both forward away from the burner (22) and laterally toward the lateral ends of the burner box. This substantially lateral orientation of the grille portions (92,94) also prevents overheating of the burner box surfaces above, below, and forward of the flameholder (42).

To prevent combustion gas from recirculating into the multiplicity of flames emanating from the grille (90), the outer surface of the grille (90) is shielded at its periphery, except near the ignitor. At the top and bottom edges of the grille (90), the top and bottom plates (102,104) extend outward from the outer surface of the flameholder (42), e.g., 0.19 inch. At the lateral edges of the flameholder (42), vertical rectangular shields (108,110) made, for example, from 0.125 inch cold rolled steel, project perpendicularly from the outer surface, e.g., about 0.38 inch.

Figure 8:
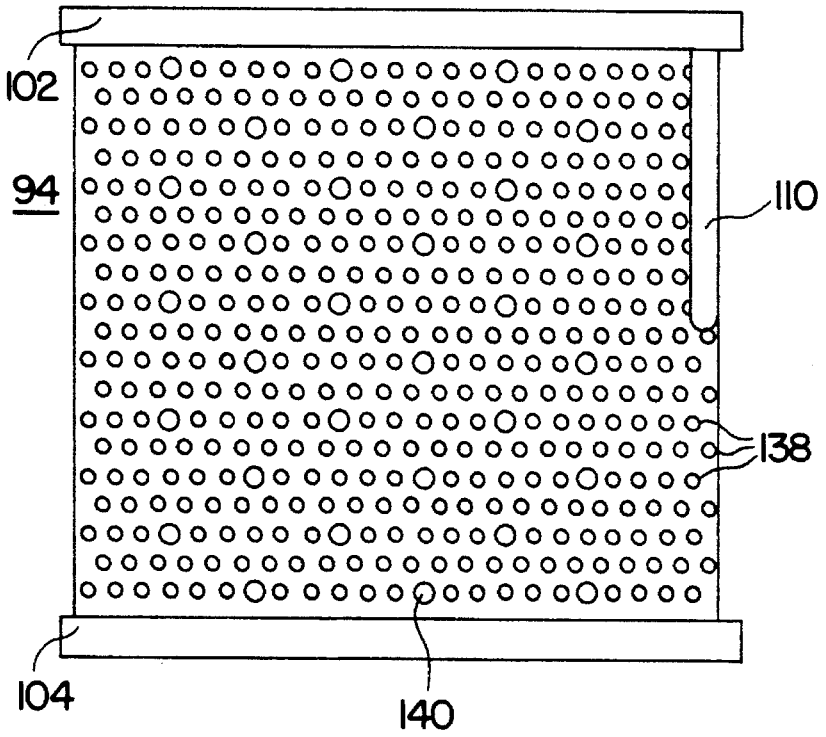
FIG. 8 is a front view of one of the two opposed portions of the grille of the flameholder of the present invention.
Figure 9:
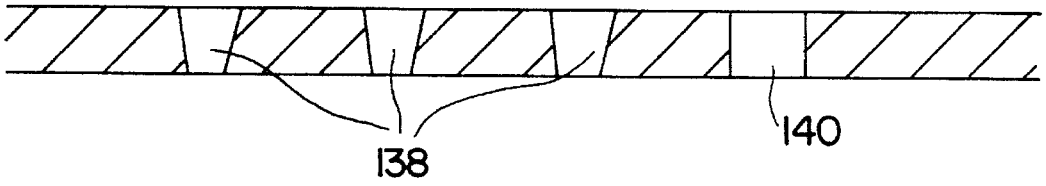
FIG. 9 is a cross-sectional side view of a portion of a row of ports of the grille of the flameholder of the present invention.

The grille is shown in more detail in FIGS. 8 and 9. FIG. 8 is a front view of the grille portion (94) on the side of the flameholder proximate to the ignitor. In the preferred embodiment the grille portion (94) has nineteen rows of ports (138,140) between the top and bottom plates (102, 104). Each row preferably contains twenty-three ports (138, 140) centered 0.156 inch apart and 0.156 inch from each of the adjacent ports (138,140) in adjacent rows. The use of 0.156 standard centering results in a hexagonal pattern of six ports (138,140) surrounding a center port. A few of the ports (138,140) are covered by the recirculation-reducing shield (110) projecting from the lateral end of the grille portion (94). The shield (110) on this grille portion (94) extends along only approximately one-half of the edge of grille portion (94) so as to leave a path for the ignitor electrodes.

To reduce to a comfortable level problematic noise caused by combustion driven oscillation, which occurs at the higher burner output level when all ports are similarly sized, larger ports (140) are interspersed among smaller ports (138) in the grille portion (94). In the preferred embodiment thirty larger ports (140) are interspersed among 427 smaller ports (138). In the preferred embodiment the thirty larger ports (140) are located in the ten odd-numbered rows. Each odd numbered row contains three larger ports (140) spaced 0.936 inches (six port positions) apart. The three larger ports (140) in a given row are shifted 0.468 inches (three port positions) with respect to those in a neighboring row, producing a staggered array of the larger holes (140) that is advantageous for fabrication, as well as noise reduction, purposes.

The preferred array contains a geometrically repetitive pattern of a center, larger port (140) surrounded by four concentric hexagons of ports. The inner first, second, and third hexagons are formed by six, twelve, and eighteen smaller ports (138), respectively, while the outer fourth hexagon is formed from six larger ports (140) and eighteen smaller ports (138), with one of the six larger ports (140) centered at each midpoint of the six sides of the hexagon. The flames produced by the larger ports (140) are sufficiently large and sufficiently close with respect to the flames produced by the nearby smaller ports (138) to draw out these flames to longer lengths. As a consequence, the topography of the imaginary surface formed by interconnecting the flames at their tips deviates from the flat type of topography tending to induce combustion driven oscillation. To obtain a significant change in this topography, the larger ports (140) should be sized and located so as to be within one and one-half larger port diameters of the adjacent smaller ports.

As illustrated in FIG. 9, which is a cross-sectional view of a portion of a row of ports (138,140) of the grille, each of the smaller ports (138) tapers in diameter from a larger diameter at the outer surface of the grille to a smaller diameter at the opposite inner surface; the larger ports (140) do not taper but have the same diameter at both surfaces. Preferably the smaller ports (138) have 0.080 inch diameters at the outer surface and 0.063 inch diameters at the inner surface. This provides a taper of 0.017 inches in diameter over the 0.125 inch distance from the outer surface to the inner surface of the grille, which translates into a side-to-side taper of 7.74°. The smaller ports (138) can be shaped to provide a greater taper; however, a side-to-side taper of approximately 15° or more will cause the fuel mixture to detach from the sides of the ports before it reaches the outer surface, creating undesirable recirculation zones. The larger ports (140) preferably have 0.093 inch diameters.

With a side to side taper of approximately 7.75°, the cross-sectional port area at the outer surface of the grille is approximately 70% greater than the cross-sectional area at the inner surface. As a consequence, approximately 70% fewer ports are required to accommodate the flow of fuel mixture at the burner's higher output level, reducing appreciably the fabrication cost of the flameholder.

Selection of the diameter for the majority, smaller ports (138) and the thickness of the grille is based upon the fuel and fuel mixture used. The preferred oven uses natural gas for fuel, premixed with air in a 12 to 1 ratio of air to fuel, although this ratio can vary. The preferred ratio, which is 120% of the ideal 10 to 1 air to fuel ratio for complete combustion of natural gas, provides leeway for imperfect mixing. For a fuel mixture of 12 parts air per 1 part natural gas, the quench diameter is approximately 2.0 mm or 0.080 inch. To provide sufficient leeway for foreseeable variations in fuel consistency, temperature, and turbulence which may affect self-extinguishing capability, the majority, smaller ports preferably have inside diameters of 0.063 inch, 0.017 inch less than the quench diameter, and depths of 0.125 inch, twice the ports' diameters.

Figure 10:
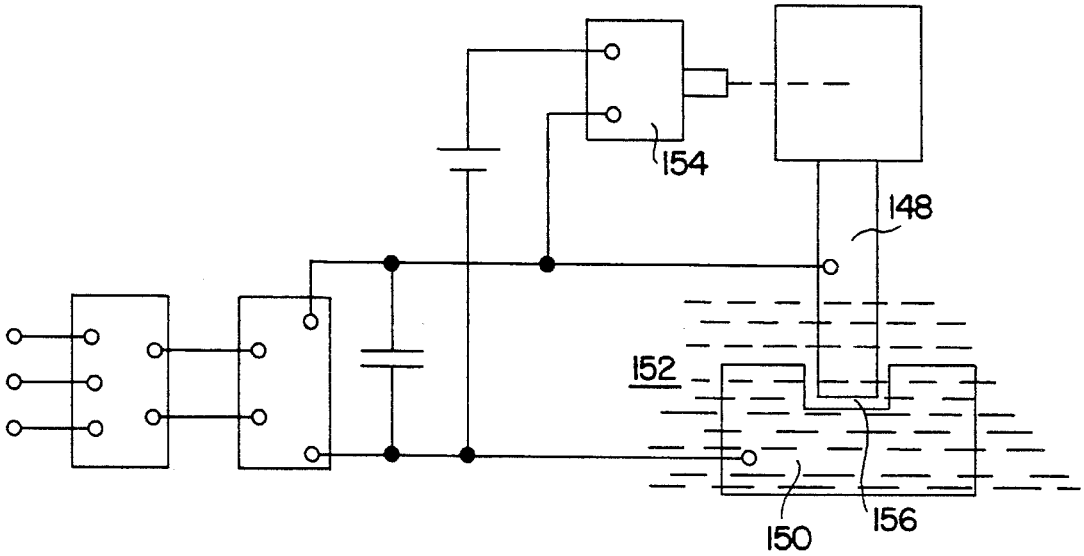
FIG. 10 is a schematic diagram of the electro-discharge machine used in the fabrication of the flameholder of the present invention.

Because a metal punch cannot ordinarily make holes of such a small diameter through such a relatively thick plate without substantially deforming the plate, an electro-discharge machine (EDM) process is used to make the ports. As explained in *Materials and Processes in Manufacturing*, by Paul E. DeGarmo (The McMillan Company, 1970) at pages 683–685, this process removes metal through the action of high-energy electric sparks upon the surface of the plate or other workpiece being worked on. An EDM machine is schematically illustrated in FIG. 10. Both the sparking tool (148) and plate (150) are submerged in a dielectric (152), such as a light oil. A servo system (154) maintains a thin gap (156) of approximately 0.001 inch between the tool (148) and plate (150). Whenever the charging of the EDM's condensers causes the voltage across the gap (156) to become sufficiently high, a spark with a current density on the order of 106 amperes discharges through the gap (156). When the voltage across the gap (156) has diminished to about 12 volts, the spark discharge stops and the condensers start to recharge. This cycle is repeated thousands of times per second, with each discharge removing minute amounts of materials from both the sparking tool (148) and the plate (150).

A programmable Computer Numerical Control (CNC) is coupled to the electro-discharge machine to produce the previously described array of ports illustrated in FIG. 8 for both portions of the grille. The EDM is set to make 0.063 inch diameter holes at all port locations, including the locations for the larger ports. In a plate of 0.125 inch thick cold rolled steel, the EDM produces holes with a side-to-side taper of 7.74° from the surface facing the sparking tool to the opposite surface. As a consequence, these holes have 0.063 inch diameters at one plate surface, but 0.080 diameters at the other. Sixty of these holes, selected to provide the geometrically repetitive pattern previously described, are then drilled out to uniform 0.093 inch diameters to make the larger ports (140). The 854 remaining tapered holes form the smaller ports (138). The grille portions are formed by bending the plate along its axis of symmetry, placing thirty smaller ports (138) and 427 larger ports (140) in each 2.75 inch by 3.26 inch portion.

Figure 11:
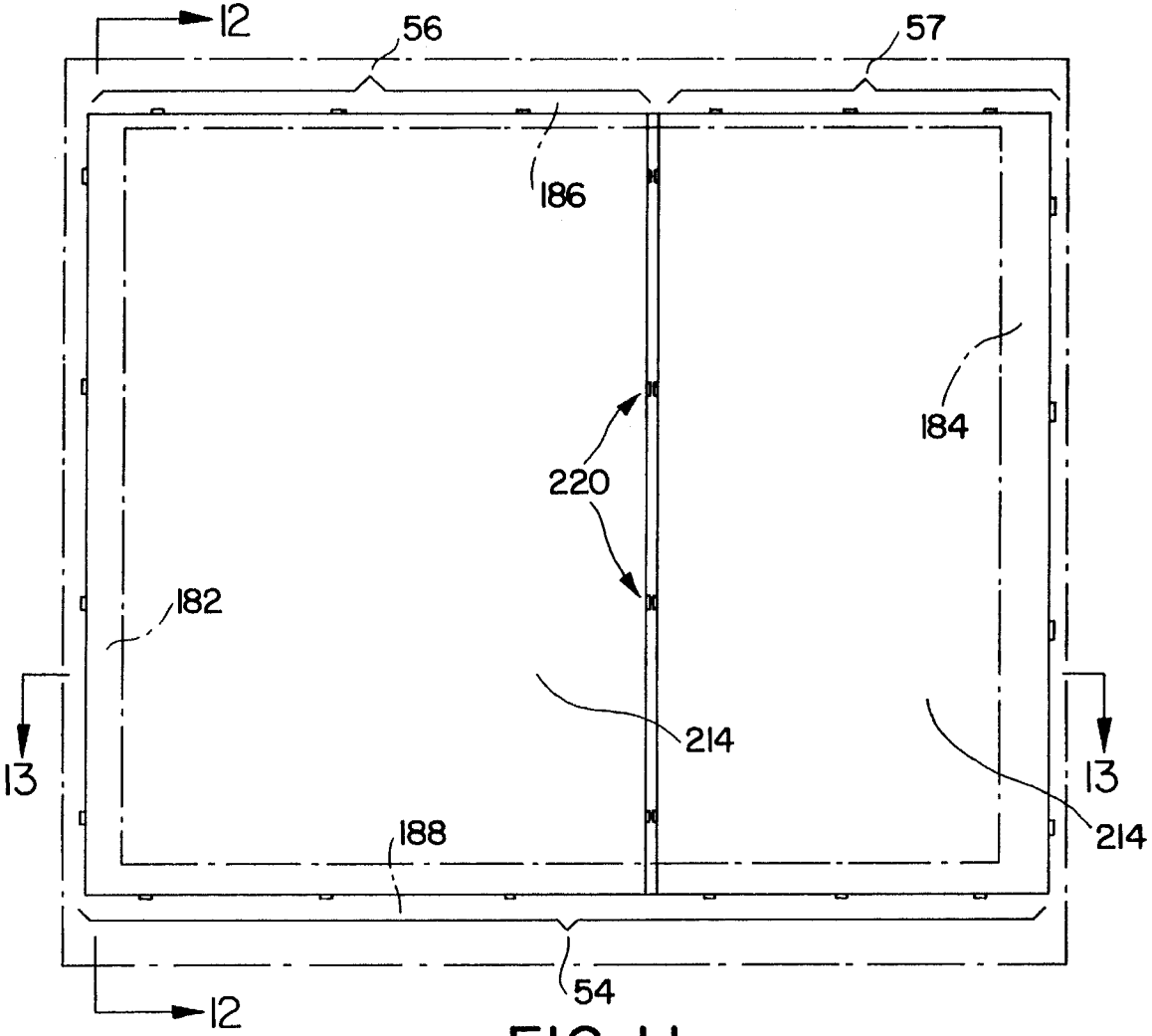
FIG. 11 is a front view of the oven door of the present invention.

The preferred door for the oven which was illustrated in FIG. 1 is shown again in FIG. 11, this time in a front view. In the preferred embodiment the door (54) has a height of 25 inches and is divided into two sections (56,57). The larger section (56), which is on the left side of the oven in the front view, is typically 18.78 inches wide; the smaller section (57), which is on the right side of the oven in front view, is typically 12.78 inches wide. Both sections are typically 2.5 inches thick. Each section (56,57) has a one-piece skin made up of a rectangular outer panel (214) and interconnected sidewalls. The skin for each section is attached via its sidewalls to the internal frame supporting each section by screws (220) spaced around the periphery of each door section (56,57). In the preferred embodiment, fourteen #10-32 0.375 inch long screws (220) are used for this purpose.

Figure 12:
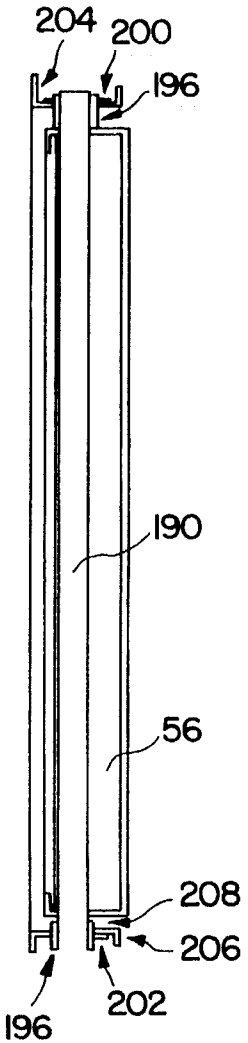
FIG. 12 is a sectional view along the line 12—12 of FIG. 11.

The oven cavity frame behind the periphery of the door (54) has a front surface in the shape of a rectangular ring. In the preferred embodiment the sides (182,184) of the frame measure about 2.0 inches across from inside to outside; the top and bottom (186,188) of the frame (180) measure about 2.0 inches across from inside to outside. The door sections (56,57) swing from hinges mounted in front of the oven cavity frame sides (182,184). A sectional view through the hinging axis of the large section (56) is illustrated in FIG. 12. The hinge (190) is typically a 0.875 inch diameter steel shaft affixed in the door section (56). Above and below the door section (56), the hinge (190) rotates in cylindrical Garlock bearings (196,198) held in place by horizontal retainer plates (200,202) affixed by screws to flanges (204,206) extending from the top and bottom of the oven. Spacers (208) which rest on the bottom flange (206) and extend over and above the bottom bearing (198) between the bearing (198) and the bottom of the door section (56) prevent the door section (56) from exerting downward pressure on the bearing (198).

The hinges of the two door sections are fixedly connected to sprocket wheels which are linked by a chain loop in the bottom of the oven. The sections of the chain between the sprocket wheels do not run parallel with respect to each other but, rather, cross each other once, giving the chain loop the shape of an elongated figure eight. This linkage configuration translates movement of one door section into a symmetrical movement of the other door section. Thus, a forward pull of the handle on the larger door section when it is in a closed, unlatched position will cause the smaller door section to open simultaneously with the larger door section.

Figure 13:
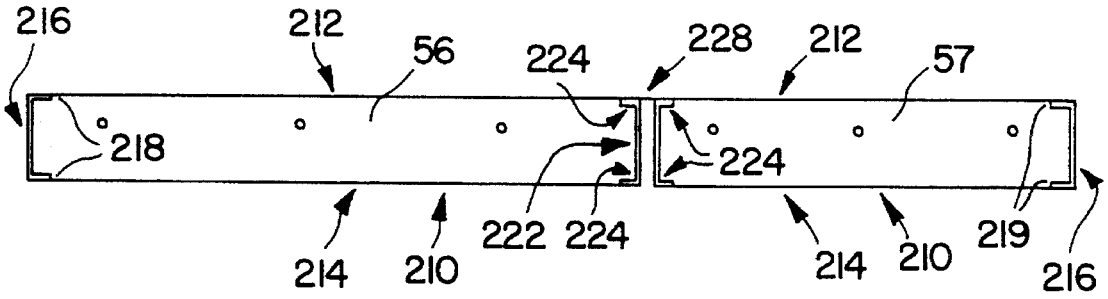
FIG. 13 is a sectional view along the line 13—13 of FIG. 11.

As illustrated in cross-section in FIG. 13, the internal frames (218,219) for the two door sections (56,57) are each composed of a rectangular band (222), which fits against the inside of the door section sidewalls (216), and of support flanges (224) perpendicularly interconnected with the band (222) at its opposite inner and outer edges so as to form two peripheral lips, one of which extends, e.g., 0.5 inch, from the band (222) along the periphery of the inner panel (212) of the door section, the other of which extends approximately the same distance from the band (222) along the periphery of the opposite outer panel (214) of the door section. The frames (218,219) preferably are made of 16 gauge cold rolled steel, although the other materials can be used. Preferably the outer skins (210) of each door section, of which the outer panels (214) are a part, are made of T304 18 gauge stainless steel, while the inner panels (212) are also made of 18 gauge stainless steel, although other materials can be used.

When the door sections (56,57) are in closed position, there is a very small gap between them. To reduce potential heat loss from the oven cavity by convection through this gap, a blocking flange (228) is integrally connected to the outer skin (210) of the small door section (57) at the rearward edge of the sidewall (216) facing the large door section. The blocking flange (228) preferably is made of 18 gauge stainless steel and extends 1.0 inch perpendicularly from the sidewall (216) across the gap and behind the inner panel (212) of the large door section (56), although other materials and spacings can be used. To keep the door sections (56,57) closed, any suitable latching mechanism familiar to a person of ordinary skill in the art may be used.

Figure 14:
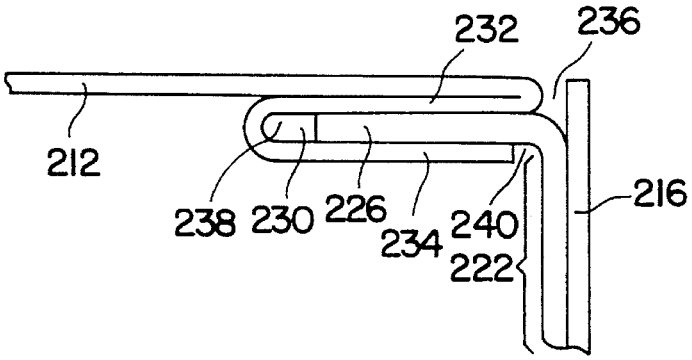
FIG. 14 is an enlarged view of the upper right corner of the sectional view of FIG. 13.

The inner panels (212) of each door section (56,57) are connected to their respective frames (218,219) in a tongue-and-groove fashion which leaves gaps for expansion of the panels (212) with respect to the frames (218,219) and the sidewalls (216). A sectional view of the connection between the small door section inner panel (212) and small door section frame (219) is shown in FIG. 14. Along its periphery, the inner panel (212) is double-hemmed. For example, it folds back approximately 180° upon itself for ½ inch along the surface facing the opposite outer panel then folds back approximately 180° again in the direction of the opposite outer panel so as to leave a ½ inch long by 1/16 inch wide groove (230) between the two hems (232,234). The inner panel (212) is sized so that its height and width dimensions are each a predetermined amount, typically ⅛ inch, less than the corresponding vertical and horizontal distances between opposing sidewalls. When the lip (226) of the frame (219) is snugly but not tightly fit into the groove (230) along the periphery of the inner panel (212), this leaves a first gap (236) of approximately 1/16 inch between the periphery of the inner panel (212) and the nearby sidewall (216), a second gap (238) of approximately 1/16 inch between the edge of the lip (226) and the closed back end of the groove (230), and a third gap (240) of approximately ⅛ inch between the peripheral edge of the second inner panel hem (234) and the band (222) of the frame (219).

This three-gap arrangement allows the inner panel (212) to expand peripherally with respect to the sidewalls (216). The gaps (236,238,240) are sufficiently large relative to the size of the inner panel (212) to accommodate the expansion of the inner panel (212) when the temperature of the oven rises at least 200° F. above 900° F.

Referring back to FIG. 13, the preferred oven door (54) is assembled according to a sequence of steps, starting with internal frames (218,219) which have not yet been closed to form rectangles. Each frame (218,219), one for each door section (56,57), is fit around that section's inner panel (212) so that the lip of the frame fits into the groove of the panel (212). After the frames (218,219) are closed by welds, the door sections (56,57) are filled with suitable insulation, e.g., 8 lb./ft$^3$ insulation such as Durablanket®-8. "Durablanket" is a registered trademark of Carborundom Company. Next, the skins (210) are fit over the frames (218,219) and suitably secured, such as with screws. Finally, the hinges are inserted into the door sections (56,57) through holes punched in the frames (218,219) and skins (210) prior to assembly.

Thus, accordingly a self-cleaning gas-fueled oven for cooking has been described which is capable of repeatedly self-cleaning at temperatures exceeding 900° F. The oven has a two-stage burner, one stage for producing oven temperatures below 500° F. and an additional stage for producing oven temperatures above 900° F.; a flameholder for the burner which has a grille divided into two opposed, substantially flat portions, each portion containing multiple ports of two distinct sizes, with the ports of the smaller size increasing in cross-sectional area from the inner surface of the grille to the outer surface; and an oven door which has a lip extending substantially perpendicularly from the door's sidewalls so as to overlap the periphery of the door's inner panel. By using substantially fewer ports than prior flameholders, by substantially reducing the noise produced at temperatures exceeding 900° F., and by directing the flames produced by the burner substantially laterally away from the top and bottom of the oven burner box, the flameholder accommodates repeated operation of the oven at self-cleaning temperatures exceeding 900 ° F. By permitting the peripheral expansion of its inner panel relative to its sidewalls, the preferred oven door accommodates repeated operation of the oven at self-cleaning temperatures exceeding 900° F.

In this disclosure, there is shown and described only the preferred embodiment of the invention, but as aforementioned, it is to be understood that the invention is capable of use in various other conditions and environments and is capable of changes or modifications with the scope of the inventive concept as expressed herein.

What is claimed is:

1. In a gas-fueled oven, the improvement comprising an improved flameholder, for the passage of gas therethrough and subsequent ignition, for the direct heating of the interior of said oven, said flameholder comprising: a grille having first and second sets of ports, of different shapes, extending between and through opposite inner and outer surfaces of said grille, each of said sets of ports extending completely through said grille, each of said sets containing at least two ports, wherein each port of said second set has a minimum cross-sectional area which is greater than the minimum cross-sectional area of each port of said first set, and wherein each port of said first set increases in cross-sectional area from said inner to said outer surface.

2. A gas-fueled oven according to claim 1, wherein each port of said first set has substantially similar minimum cross-sectional areas.

3. A gas-fueled oven according to claim 2, wherein each of said ports is centered a substantially similar distance from each adjacent port.

4. A gas-fueled oven according to claim 3, wherein each of said ports has substantially circular cross sections.

5. A gas-fueled oven according to claim 4, wherein said substantially similar distance between adjacent ports is at most approximately 150% of the mean of the diameters of the second set of ports.

6. A gas-fueled oven according to claim 5, wherein said grille has at least three ports of said first set for each port of said second set.

7. A gas-fueled oven according to claim 6, wherein said grille includes two opposed, substantially rectangular and substantially flat portions which form an angle of approximately 90° with respect to each other.

8. A gas-fueled oven according to claim 4, wherein said grille includes two opposed, substantially flat portions which form an angle of approximately 90° with respect to each other.

9. A gas-fueled oven according to claim 4, wherein each port of said first set increases in cross-sectional area from said inner surface to said outer surface.

10. A gas-fueled oven according to claim 9, wherein said grille includes two opposed, substantially flat portions which form an angle of approximately 90° with respect to each other.

11. A gas-fueled oven according to claim 1, wherein each port of said first set increases in cross-sectional area from said inner surface to said outer surface.

12. A gas-fueled oven according to claim 11, wherein said grille includes two opposed, substantially flat portions.

13. A gas-fueled oven according to claim 11, wherein said ports are formed in accordance with an electro-discharge machine process.

14. A gas-fueled oven according to claim 13, wherein said grille includes two opposed, substantially rectangular and substantially flat grille portions which form an angle of approximately 90° with respect to each other.

15. A gas-fueled oven according to claim 1, wherein said grille includes two opposed, substantially flat portions.

16. In a gas-fueled oven, the improvement comprising an improved flameholder, for the passage of gas therethrough and subsequent ignition for the direct heating of the interior of said oven, said flameholder comprising: a grille having at least two sets of multiple ports, of different shapes, between opposite inner and outer surfaces, wherein each port of a first set increases in cross-sectional area from said inner to said outer surface.

17. A gas-fueled oven according to claim 16, wherein each of said ports has substantially circular cross sections.

18. A gas-fueled oven according to claim 17, wherein said ports are formed in accordance with a electro-discharge machine process.

19. A gas-fueled oven according to claim 18, wherein said grille includes two opposed, substantially flat portions.

20. A gas-fueled oven according to claim 19, wherein said opposed grille portions form an angle of approximately 90° with respect to each other.

21. A gas-fueled oven according to claim 20, wherein said opposed grille portions are substantially rectangular.

22. In a gas-fueled oven, the improvement comprising an improved flameholder for the passage of gas therethrough and subsequent ignition, for the direct heating of the interior of said oven, the flameholder comprising: a grille having at least two sets of multiple ports, of different shapes and wherein the ports of each respective set are of substantially uniform configuration relative to the other ports of said respective set, between opposite inner and outer surfaces, wherein said grille includes two opposed, substantially flat portions.

23. A gas-fueled oven according to claim 22, wherein said opposed grille portions form an angle of approximately 90° with respect to each other.

24. A gas-fueled oven according to claim 23, wherein said opposed grille portions are substantially rectangular.

* * * * *